United States Patent [19]

Nussbaumer et al.

[11] Patent Number: 5,061,510

[45] Date of Patent: Oct. 29, 1991

[54] PROCESS FOR REDUCING ENVIRONMENTAL INFLUENCES ON THE POWDER COATING OF A WORKPIECE, AND POWDER COATING FACILITY

[75] Inventors: Hans Nussbaumer, Wagen; Felix Walser, Hinwil, both of Switzerland

[73] Assignee: Prazisions-Werkzeuge AG, Ruti, Switzerland

[21] Appl. No.: 277,985

[22] Filed: Nov. 30, 1988

[30] Foreign Application Priority Data

Dec. 23, 1987 [DE] Fed. Rep. of Germany ..... 3743864

[51] Int. Cl.[5] ..... B05D 1/06; B05B 5/03

[52] U.S. Cl. ..... 427/28; 427/33; 427/180; 427/181; 118/309; 118/312; 118/317; 118/326; 118/622; 118/634

[58] Field of Search ..... 118/602, 634, 312, 326, 118/622, 309, 317; 427/27, 33, 180, 181, 28; 55/DIG. 17

[56] References Cited

U.S. PATENT DOCUMENTS

| | | | |
|---|---|---|---|
| 4,015,959 | 4/1977 | Grote | 55/DIG. 17 X |
| 4,205,621 | 6/1980 | Payne et al. | 118/622 |
| 4,301,764 | 11/1981 | Caupion et al. | 118/634 |
| 4,376,143 | 3/1983 | Lehmann | 427/28 X |
| 4,400,187 | 8/1983 | Lane | 55/DIG. 17 X |
| 4,500,560 | 2/1985 | Cuttroy | 427/27 X |
| 4,687,686 | 8/1987 | Stofleth et al. | 118/326 X |

FOREIGN PATENT DOCUMENTS

| | | |
|---|---|---|
| 676226 | 12/1968 | Belgium . |
| A0230147 | 7/1987 | European Pat. Off. . |
| 2636898 | 2/1978 | Fed. Rep. of Germany . |
| 3500005 | 7/1986 | Fed. Rep. of Germany . |
| 2153249 | 5/1973 | France . |

*Primary Examiner*—Evan Lawrence

*Attorney, Agent, or Firm*—Antonelli, Terry Stout & Kraus

[57] ABSTRACT

In a powder coating facility wherein powder entrained with conditioned air sprayed from a feed conduit (11) to a workpiece, such as a can body (51), and excess powder is returned by suction by means of exhausts (29, 25), a conditioning chamber (21) is arranged around the coating zone (15) in order to prevent contamination of the dispensed powder due to influences of the enviroment (U). An air flow (S) is provided, produced from openings (23) of the chamber (21), to conduct the can bodies (51) into and through the chamber (21). The air flow from the openings of the chamber prevents influences of the ambient surroundings of the chamber powder sprayed and retrieved in the powder coating facility.

47 Claims, 2 Drawing Sheets

PROCESS FOR REDUCING ENVIRONMENTAL INFLUENCES ON THE POWDER COATING OF A WORKPIECE, AND POWDER COATING FACILITY

FIELD OF THE INVENTION

The present invention relates to a process for reducing environmental influences on powder coating of a workpiece, in which coating process the workpiece is coated at least in part in a coating zone from a powder feeder with air-conveyed powder; to a powder coating facility; and to application of the process and, respectively, use of the powder coating facility.

BACKGROUND AND SUMMARY OF THE INVENTION

In the powder coating of workpieces, especially coating of the latter with synthetic resin powders, such as in the synthetic resin powder coating of can bodies, inter alia their longitudinal weld seam, the problem arises basically that environmental factors, such as atmospheric humidity, degree of contamination, affect the properties of the film formed on the workpiece by repeated melting of the applied powder. Such coating procedures are frequently utilized in line in the immediate vicinity with other processing stations, such as with welding units for the longitudinal seams of can bodies as the workpieces; as a consequence, the ambient air is contaminated with oil vapors and other vaporization products of the welding step.

The invention has the objective of at least reducing effects of the environment on the result of the coating process; this objective is achieved in a process of the above kind in accordance with the invention by conditioning the air and at least extensively preventing penetration of ambient air at least to the coating zone for the workpiece.

On account of the feature that the air by means of which the powder is conveyed to the powder feeder is conditioned, i.e. its atmospheric humidity is maintained at a predetermined value, and that air is used, the residual contamination degree of which influences the powder coating only to a negligible extent, in conjunction with the feature that air from the immediate surroundings is precluded from penetrating to the coating zone, the objective is attained that the coating procedure can take place under predetermined, controlled environmental parameters. In this connection, first priority must be given to the essential feature that such measures are to be taken at the coating zone proper, i.e. at the location where the powder is delivered and applied to the workpiece. Additionally, an environment, controllable as described above, is maintained with respect to the workpiece with the powder application preferably for such a time period until the powder coating to be produced can no longer be impaired by fluctuating environmental influences.

In conventional powder coating processes wherein workpieces are coated in series one after the other, the powder feeder being moved relatively to the workpiece during the coating step, the additional suggestion is advanced, for preventing penetration of ambient air, to provide a chamber that is open at least on one side for the relative movement between workpiece and powder feeder, and to produce an air flow out of the chamber opening into the surroundings.

By providing such an air flow from the chamber arranged around the coating zone, it is ensured that only conditioned air, thus the powder conveying air, enters the chamber.

It is furthermore known in powder coating processes to return by suction any powder not applied to the workpiece and/or not remaining applied to the workpiece, this sucked-back powder usually being recycled to the powder feeder in a conveying cycle. The powder, delivered in this arrangement in a closed cycle repeatedly to the coating zone, which usually is in free communication with the immediate environment, becomes increasingly soiled at the coating zone and also absorbs increasing amounts of moisture. Even though the problem of growing moisture in the powder can perhaps be controlled in a powder processing unit at relatively high expense, it is impossible in the aforementioned conveying cycle to keep the repeatedly fed powder clean at reasonable expense. For this reason, quite special significance resides in utilizing the process according to this invention in a powder coating procedure wherein excess powder is repeatedly dispensed in a conveying cycle along the above lines. A powder reprocessing facility and/or stage, otherwise required, thus becomes superfluous.

In a coating process wherein at least one exhaust for air and powder not applied to the workpiece and possibly, as explained above, returned in a conveying cycle to the powder feeder, is provided, it is furthermore suggested that the air flow out of the chamber opening is produced by feeding, per unit time, a larger quantity of conditioned air to the chamber than the amount of air exhausted therefrom. In this connection, the aforementioned balance of conditioned air introduced into the chamber and air removed from the chamber can also be influenced in the aforementioned sense by generating the air flow by conditioned air fed into the chamber in addition to the conditioned conveying air.

If the aforementioned outward flow from the chamber is produced exclusively with conditioned air by designing the above-mentioned balance per unit time correspondingly large in favor of the conditioned air that is introduced, then a relatively large quantity of conditioned air is used up, entailing a corresponding design of a climatizing stage and perhaps purification stage for the aforementioned air. Also, it is to be kept in mind that the amount of conditioned air conveyed per unit time is not arbitrarily adjustable because this amount directly affects the powder coating process, for example via the delivery rate. For this reason, it is desirable in most cases to separate setting parameters for the coating step from setting parameters for the flow according to this invention. To this end, conditioned air without powder is introduced into the chamber in addition to the aforementioned conveying air.

The feature of passing air through nozzles furthermore in the region of the chamber opening, and in such a case preferably unconditioned air, so that a flow of conditioned air out of the opening of the chamber toward the outside is produced in the chamber by jet pump effect, provides the result that, on the one hand, less conditioned air needs to be utilized in that the pump jet forms practically a barrier against the influx of ambient air into the chamber.

In order to prevent excess powder from settling on the chamber wall, it is furthermore proposed to electrically charge the powder predominantly in one polarity, the powder being electrostatically repelled by the chamber. This is done preferably in case the powder coating step is effected with electrostatic enhancement by producing an electrostatic field in the zone of the workpiece, charging the delivered powder, and driving the latter by the force of the field against the workpiece. In this case, for example, a metallized inside wall of the aforementioned chamber, designed insulated toward the outside for protection against electric shock, is placed at the same electric potential as an electrode in the coating zone, this electrode generating, together with the workpiece placed at corresponding electric potential, the electrostatic field for applying the powder.

A powder coating facility according to this invention, where environmental influences are mitigated, comprises a conditioning chamber, at least one feed conduit extended into the chamber and terminating in a coating zone for powder conveyed by means of conditioned air, an air conditioning device connected to the feed conduit as well as likewise connected to conveying means for the conditioned air with powder, at least one opening in the chamber for the introduction of a workpiece to be coated, and means for producing at the chamber opening an air flow oriented toward the surroundings of the opening. The process of this invention as well as the powder coating facility according to this invention are suited, in particular, for the internal coating of hollow items, in this connection also especially for the seam coating of longitudinal weld seams in can bodies, taking place customarily directly downstream of a welding facility where the contaminations mentioned in the foregoing are relatively pronounced. The aforementioned process and, respectively, coating facility, however, can also be utilized for the all-around internal coatings of hollow articles.

BRIEF DESCRIPTION OF DRAWINGS

The invention will be described in greater detail below with reference to the drawings wherein.

DETAILED DESCRIPTION OF DISCLOSED EMBODIMENTS

Figure 1:
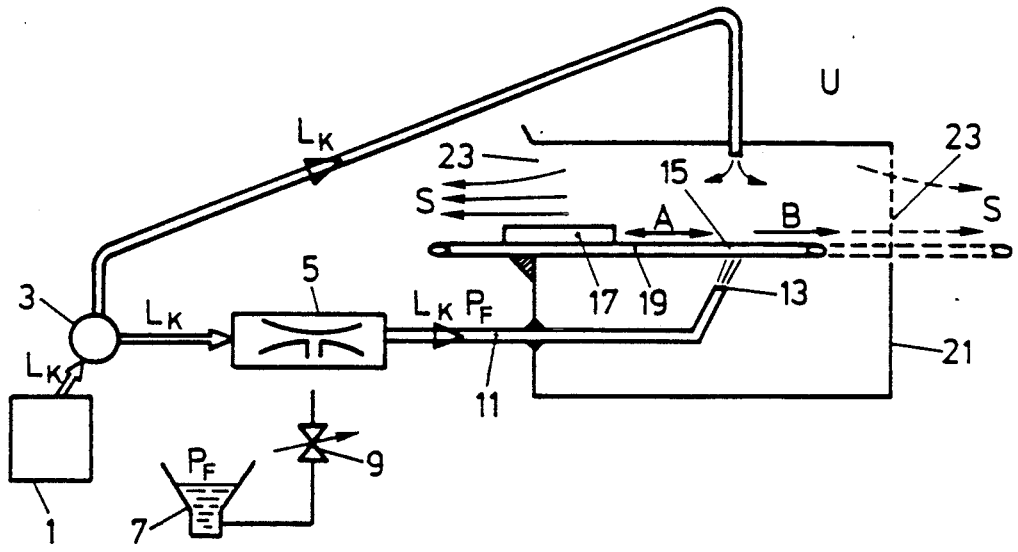
FIG. 1 shows schematically a first embodiment of a powder coating facility according to this invention, operating in accordance with a process of this invention.

According to FIG. 1, a powder coating facility comprises an air conditioning unit 1 wherein ambient air is conditioned, for example maintained at a predetermined atmospheric humidity and/or purified of dust, oil particles, etc. The ambient air $L_K$ conditioned in unit 1 is fed by way of a conveying means 3, such as a fan, to a mixing unit 5, for example with a diffuser as illustrated schematically, where fresh powder $P_F$ fed from a powder storage tank 7 is mixed, optionally by way of a volume control device 9, with conditioned air $L_K$ fed thereto. On the outlet side of the mixing unit 5, fresh powder $P_F$ is conveyed with the conditioned air $L_K$ via a feed conduit 11 to a delivery means 13 in a coating zone 15 and dispensed at that location. A workpiece 17 to be coated, such as a can body to be coated on the inside or outside, the longitudinal weld seam of which is to be powder coated, is introduced into the coating zone 15 by means of a schematically illustrated conveyor 19 and, after termination of the coating step, either returned again along the same route, as indicated by double arrow A, or further conveyed out of the coating zone 15 in the same direction, in case of a procedure continuous in one direction, as shown by arrow B.

In order to reduce, in accordance with this invention, effects of the environment U on the coating of the workpiece 17 produced at the coating zone 15, such as fluctuations of relative atmospheric humidity, contaminants in the air, in this connection particularly from processing stations for the workpiece 17 arranged upstream or downstream thereof, the penetration of air from the surroundings U is maximally prevented, at least at the coating zone 15.

This is achieved by providing, as shown in FIG. 1, a conditioning chamber 21 which encompasses especially the coating zone 15 and optionally additionally a predetermined section within which the workpiece 17 is traveling after the freshly applied coating. This additional route optionally likewise enclosed by the conditioning chamber 21 can also comprise further systems, such as a first heating stage by means of which the applied synthetic resin powder layer on the workpiece 17 is heated up to form a continuous film or film strip.

The conditioning chamber 21 exhibits, in case of pendulating feed according to double arrow A, an opening 23 through which the workpiece 17 is fed to the coating zone 15 and again removed therefrom. In case the workpiece 17, in continuous operation, is transported in one direction according to arrow B to the coating zone 15 and away therefrom, the conditioning chamber 21, as shown in dashed lines, has a second opening 23 through which then the coating workpiece 17 can be further transported by means of the conveyor 19.

Provision of the conditioning chamber 21 has the result that, neglecting the amount of $m_{PF}$ fed per unit time, based on the amount of conditioned conveying air $m_{LK}$ delivered from the outlet 13 per unit time, a flow S of conditioned air $L_K$ out of one or both provided openings 23 is maintained, preventing unconditioned air that is contaminated and/or has undesirable, uncontrollable atmospheric humidity from the surroundings U, from passing into the coating zone 15.

However, in this connection, it is to be kept in mind that the amount of conditioned conveying air fed to the chamber 21 per unit time via the feed conduit 11 is to be set predominantly based on the requirements of the coating process per se at the coating zone 15. Therefore, if this amount of conditioned conveying air introduced into the chamber 21 with a view toward a desired coating step is not sufficient for ensuring adequate flow S from one or both openings 23, then additionally conditioning air $L_K$ is fed to the conditioning chamber 21 from the conveying means 3 and from the conditioning facility 1; consequently, the flow S can then be adjusted to an adequate value, independently of the coating process.

Figure 2:
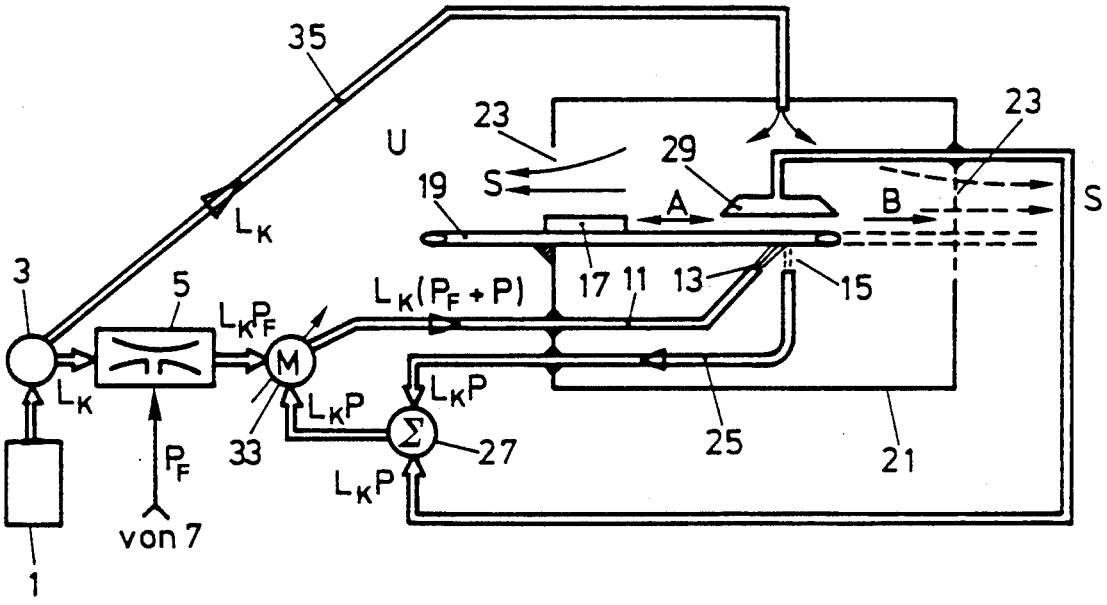
FIG. 2 shows a second embodiment of the powder coating facility operating according to a process of this invention, again in a schematic view.

FIG. 2 shows schematically a coating facility according to this invention, basically as illustrated in FIG. 1. Identical parts and/or functional blocks bear the same reference numerals as in FIG. 1.

In powder coating facilities of the type shown schematically in FIG. 1, it is conventional to return, by suction, along the lines of recovery, any synthetic resin powder that has not adhered to the workpiece 17 and/or powder exiting from the discharge means 13 when no workpiece 17 at all is present in the coating zone 15. For this purpose, as illustrated in FIG. 2, a return exhaust 25 is arranged in the zone of the delivery 13, downstream and/or upstream, connected to a corresponding suction unit 27, such as a pump. By means of this return exhaust 25, powder that has not adhered to the workpiece 17 is returned by suction with the aid of conditioned air $L_K$.

Since in many cases the powder/air stream from the discharge means 13 is not interrupted at the time the coating zone 15 does not contain a workpiece 17, i.e. until the subsequent workpiece 17 arrives, an additional return exhaust 29 is provided, with an exhaust hood 31, likewise in communication with the return exhaust unit 27.

The powder from the return exhausts 25 and 29, sucked back with conditioned air, is again fed into the feed conduit 11 in order to be reissued, in a closed cycle, at the outlet 13 against the workpiece 17. The mixture of sucked-back, no longer fresh powder P with the fresh powder $P_F$ from the powder tank 7 is effected, for example, by a dosing means and/or a mixer 33.

Without provision of the features according to this invention, precisely the operation of such a powder cycle, wherein powder already applied once or several times is mixed with fresh powder and reapplied, is prone to incur an increasingly impaired coating action, for the powder, applied again and again, absorbs moisture and dirt, such as oil vapors, etc., of processing stages arranged upstream or downstream thereof, from the surrounding air, with a practically integral characteristic over time.

This problem is eliminated by providing the conditioning chamber 21 of this invention, and there is no need to include an expensive powder reprocessing stage for dehumidifying and/or purifying the reapplied powder that has already been utilized once or repeatedly.

In order to produce an outward flow S in this case at one or both openings 23, the balance of conditioned air $m_{LKin}$ fed per unit time to the chamber 21 via the feed conduit 11 and of the amount of air $m_{LKout}$ returned by suction per unit time by means of the return exhausts 25 and 29 is chosen to be positive in favor of the amount of air introduced into the chamber 21. To avoid having to optimize the quantitative parameters determining the actual coating step, the amount delivered from conduit 11 and the amount returned by suction, especially at 25, in deference to additional requirements, namely production of an adequate flow S, it is here also suggested to provide, starting at the conveying means 3, additionally a conditioning air conduit 35, with the aid of which additional conditioned air $L_K$, along the lines of a positive effect on the aforementioned balance, is introduced into the chamber 21. In this way, the objective is achieved that the powder, on the whole freely exposed in the coating zone 15, cannot be contaminated by the environment U, thus eliminating the need for expensive processing steps, as mentioned above. The powder cycle, otherwise open at the coating zone 15, is accordingly closed with respect to the environment U by means of the chamber 21 also at that location.

In the embodiments according to FIGS. 1 and 2, the flow S from the provided openings 23 of the chamber 21 is generated exclusively by conditioned air; as a consequence, a relatively high-power conditioning unit 1 must be included.

Figure 3:
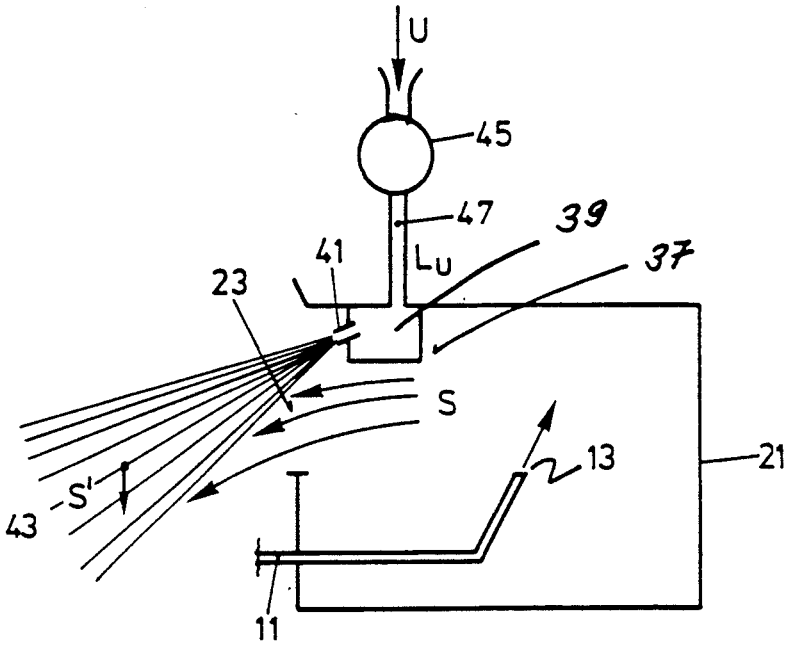
FIG. 3 is a schematic view of a chamber in a powder coating facility according to this invention.

FIG. 3 illustrates schematically a further version of producing the flow S, usable in connection with both arrangements according to FIGS. 1 and 2. Here again, the same reference symbols are utilized for identical parts. In FIG. 3, all of the elements of the facility according to FIGS. 1 and 2 unnecessary for explaining the procedure for producing the flow S according to this invention have been omitted.

A nozzle array 37 is provided in the region of the opening 23, for example a slotted nozzle arrangement along the periphery of said opening 23, or a plurality of individual nozzles jointly supplied through a duct 39. A jet 43 exits as a free jet from the nozzle or nozzles 41. Due to the fact that the jet 43 is oriented at least in one component S' transversely to the opening 23, air is pulled from the interior of chamber 21 by the formation of the jet and is conveyed into the surroundings: Thereby, the desired flow S out of the opening 23 is produced. The jet 43 from the nozzle arrangement 37 can now be generated with ambient air $L_U$ by means of a conveying unit 45; as a result, the conveyor 45 can be located in the immediate vicinity of chamber 21, only short conduits 47 are required, and less conditioned air $L_K$ is used up for the flow S. The jet 43, in accordance with the jet pump principle, has a suctioning effect on the interior of chamber 21.

Figure 4:
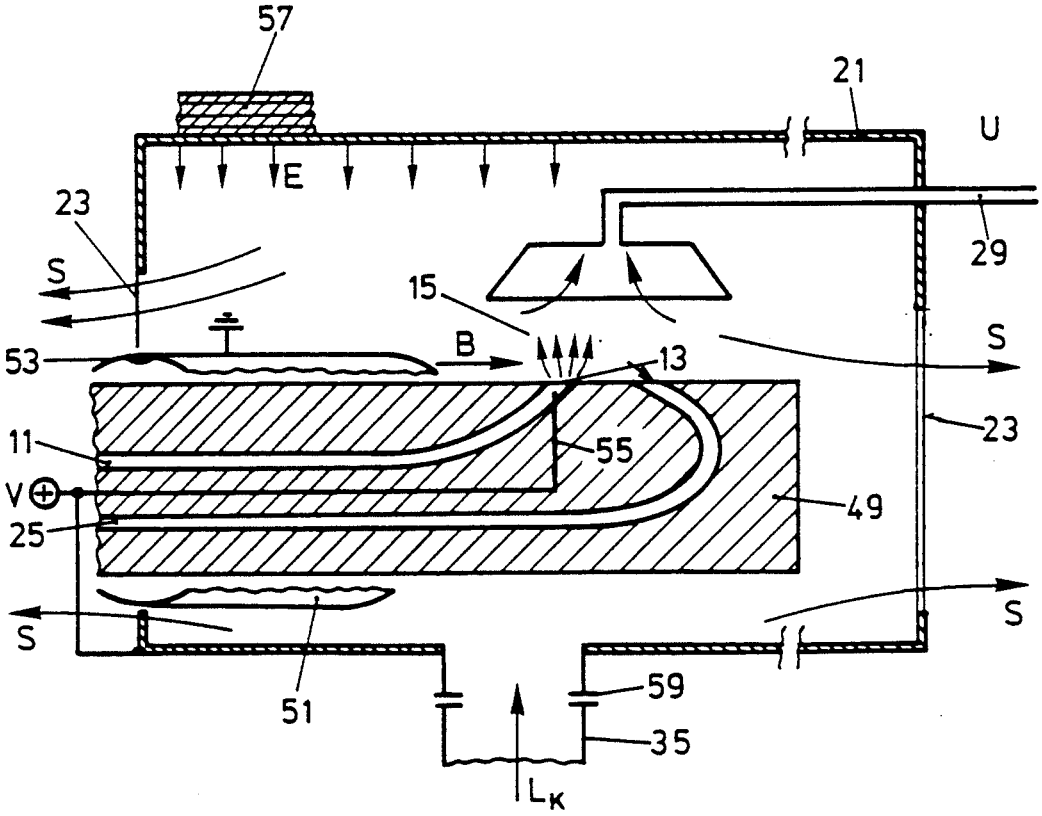
FIG. 4 shows a preferred embodiment of a powder coating facility for the internal coating of longitudinal weld seams of metal can bodies, directly downstream of a welding facility for the longitudinal weld seam.

FIG. 4 shows schematically a preferred embodiment of a coating facility of this invention, operating pursuant to the process of the invention, designed for the internal coating of weld seams of metal cans. The feed conduit 11 and the return exhaust 25 are arranged in a projecting working arm 49 which, in FIG. 4, on the lefthand side, is mounted following a welding station for the above-mentioned longitudinal weld seam and projects from there toward the right. Can bodies 51 welded together along their longitudinal edges at the welding station (not shown) are moved by means of a conveyor, not illustrated herein, in the direction of arrow B via the arm 49, through the arrangement at a spacing with respect to the orifices of the feed conduit 11 and, respectively, of the return exhaust 25. During this step, the weld seam zone 53 of the can bodies 51 is coated by the powder delivered from conduit 11 by means of conditioned air $L_K$. Excess powder, and power dropping off the can body 51 is sucked back, as mentioned above, through the return exhaust 25, and the powder fed in the upward direction between the can bodies 51 following in rapid succession is exhausted by the return exhaust 29.

The conditioning chamber 21 encompasses, in particular, the coating zone 15 and optionally also part of heating units lying downstream thereof, not shown in FIG. 4, with the aid of which the applied powder coating is fused.

The chamber 21 is supplied with additional conditioned air $L_K$ by means of the conditioning air conduit 35, in such a way that according to this invention a flow S is generated out of the openings 23 of the conditioning chamber 21.

In order to enhance the powder application to the can bodies 53, an electrode 55 is located in the zone of the discharge 13, which may be an axially symmetrical nozzle array for the internal coating of the can bodies 51; this electrode is placed at a high electrostatic potential V with respect to ground, whereas the can bodies 51 are connected to ground, for example by way of the conveyor (not shown). Thereby, a high electrostatic field is generated in the coating zone 13 oriented so that powder particles, charged primarily with one polarity, either by friction in the feed conduit 11 and/or by the effect of the electrode 55, are driven by the force of the field against the can bodies and retained thereat. To prevent powder that may not have been returned through the exhaust from settling in the interior of the conditioning chamber 21, the latter and especially its inner wall region is likewise placed at an electrostatic potential, such as the electrostatic potential V of the electrode 55, whereby a field E repelling the charged powder particles is generated in the wall zone of the conditioning chamber 21. If the inner wall of the chamber 21 is placed at a high electrostatic potential, then the outer wall of chamber 21 is furthermore equipped with an insulating jacket, as illustrated at 57, to provide protection against electric shock. Further, as shown at 59, the conduit 35 is in this case electrically decoupled from the chamber 21, and likewise additional, outwardly extending elements and parts in contact therewith.

The proposed invention, the process, or the coating facility achieve the objective that, without expensive measures, environmental influences cannot affect the quality of the powder coating and a uniformly controlled coating can be effected.

I claim:

1. A powder coating and retrieving process comprising conveying workpieces past a powder spray and powder retrieving arrangement wherein air entrained powder is sprayed towards and on the workpieces and powder not applied to the workpieces is retrieved by suction in the area of the spraying, and including entraining the powder by conditioned air; providing a chamber open at least on one side for conveying said workpieces, said chamber surrounding the area of spraying and suction retrieval; and providing an air flow out of said chamber so as to prevent influences of the ambient surroundings of said chamber on powder sprayed and retrieved in said arrangement.

2. Process according to claim 1 wherein said air flow is produced by feeding, per unit time, a larger amount of conditioned air to the chamber than the amount of air flowed out of the chamber.

3. Process according to claim 1 wherein the air flow is produced by passing air through nozzles in the zone of the chamber opening in such a way that, by jet pump effect, an outflow of air is produced from the chamber through the opening toward the outside.

4. Process according to claim 3, wherein the air ejected through the nozzles is unconditioned ambient air.

5. Process according to claim 1 further comprising electrically charging the powder predominately in one polarity, and maintaining the chamber at such potential that the powder is electrostatically repelled by the chamber.

6. Process according to claim 1, wherein the workpieces are hollow bodies which are internally coated.

7. Process according to claim 6, wherein the hollow bodies are can bodies having longitudinal weld seams which are coated.

8. Process according to claim 1, wherein excess powder which is retrieved is repeatedly discharged in a conveying cycle to become part of said air entrained powder.

9. Process according to claim 1, including maintaining said chamber at a predetermined electric potential.

10. Process according to claim 1, wherein said arrangement includes a feed conduit arranged at a projecting arm which protrudes into said chamber and a suction conduit at said arm, conditioned air entrained powder being conveyed through said feed conduit for spraying said workpieces and powder not applied to the workpieces being retrieved by suction through said suction conduit.

11. In a powder coating process comprising conveying workpieces past a powder spray nozzle arrangement which sprays air entrained powder towards and on said workpieces and wherein overspray powder is retrieved by suction so that said powder is prevented from contaminating the surroundings of said workpieces by said suctioning, the improvement comprising reducing influences from said surroundings on said powder coating process by preventing ambient air from said surroundings from penetrating to an area at least between said nozzle arrangement and a respective workpiece being coated, said preventing of penetration of ambient air being accomplished through the use of a chamber open at least on one side for conveying said workpieces, and including producing an air flow out of the chamber opening into the surroundings, and entraining said powder by conditioned air, wherein the air flow is produced by passing air through nozzles in the zone of the chamber opening in such a way that, by jet pump effect, an outflow of air is produced from the chamber through the opening toward the outside.

12. Process according to claim 11, including maintaining said chamber at a predetermined electric potential.

13. Process according to claim 11, further comprising feeding, per unit time, a larger amount of conditioned air to the chamber than is exhausted from the chamber through said chamber opening.

14. Process according to claim 11, wherein the air ejected through the nozzles is unconditioned ambient air.

15. Process according to claim 11, wherein the workpieces are hollow bodies which are internally coated.

16. Process according to claim 15, wherein the hollow bodes are can bodies having longitudinal weld seems which are coated.

17. Process according to claim 11, wherein excess powder which is retrieved is repeatedly discharged in a conveying cycle to become part of said air entrained powder.

18. In a powder coating process comprising conveying workpieces past a powder spray nozzle arrangement which sprays air entrained powder towards and on said workpieces and wherein overspray powder is retrieved by suction so that said powder is prevented from contaminating the surroundings of said workpieces by said suctioning, the improvement comprising reducing influences from said surroundings on said powder coating process by preventing ambient air from said surroundings from penetrating to an area at least between said nozzle arrangement and a respective workpiece being coated, said preventing of penetration of ambient air being accomplished through the use of a chamber open at least on one side for conveying said workpieces, and including producing an air flow out of the chamber opening into the surroundings, and entraining said powder by conditioned air, wherein the workpieces are hollow bodies which are internally coated.

19. Process according to claim 18, including maintaining said chamber at a predetermined electric potential.

20. Process according to claim 18, further comprising feeding, per unit time, a larger amount of conditioned air to the chamber than is exhausted from the chamber through said chamber opening.

21. Process according to claim 18, wherein the air flow out of the chamber opening is produced by passing air through nozzles in the zone of the chamber opening in such a way that, by jet pump effect, an outflow of air is produced from the chamber through the opening toward the outside, and wherein the air ejected through the nozzles is unconditioned ambient air.

22. Process according to claim 18, wherein the hollow bodies are can bodies having longitudinal weld seams which are coated.

23. Process according to claim 18, wherein excess powder which is retrieved is repeatedly discharged in a conveying cycle to become part of said air entrained powder.

24. A powder coating process comprising conveying workpieces past a powder spray and powder retrieving arrangement wherein air entrained powder is sprayed towards and on said workpieces and powder not applied to said workpieces is retrieved by suction in the area of the spraying, including reducing influences from the ambient air on said powder coating process by preventing ambient air from penetrating to an area of said powder spray and powder retrieving arrangement and a respective workpiece being coated, said preventing of penetration of ambient air being accomplished through the use of a chamber open at least on one side for conveying said workpieces, and including producing an air flow out of the chamber opening into the surroundings, and entraining said powder by conditioned air, and wherein said air flow is produced by feeding, per unit time, a larger amount of conditioned air to the chamber than the exhausted amount of air.

25. Process according to claim 24, further including maintaining said chamber at a predetermined electric potential.

26. Process according to claim 24, wherein excess powder which is retrieved is repeatedly discharged in a conveying cycle to become part of said air entrained powder.

27. In a powder coating arrangement comprising conveyor means for conveying workpieces to be coated, a spray nozzle arrangement for spraying air entrained powder towards and on workpieces conveyed by said conveyor means and passing said nozzle arrangement, retrieving means adjacent said nozzle arrangement for retrieving by suction overspray powder, so as to substantially prevent, per se, such powder contaminating the surroundings of said workpieces, the improvement comprising a cabin surrounding at least an area adjacent said spray nozzle arrangement and said retrieving means, said cabin comprising at least one opening to introduce and remove said workpieces into and from said cabin, and said cabin being connected to pressurizing means for providing an overpressure in said cabin with respect to said surroundings, so as to provide an air current flowing from said cabin out said at least one opening to said surroundings, wherein said spray nozzle arrangement is connected to an air conditioning device to condition the air for entraining said powder towards and on said workpieces, and further comprising a nozzle array in the region of said cabin opening, this array being designed so that on account of its jet action air is pulled from the cabin to the outside, and that the nozzle array is connected to a conveyor for air.

28. Powder coating arrangement according to claim 27, wherein said pressurizing means includes at least one conduit for conditioned air which terminates in the cabin, this conduit being in communication with an air conveyor as a means for producing an air flow directed toward the surroundings from the chamber.

29. Powder coating arrangement according to claim 27, wherein the spray nozzle arrangement includes a feed conduit arranged at a projecting air, the arm protruding into the cabin.

30. Powder coating arrangement according to claim 29, wherein said retrieving means comprises at least one suction conduit at said arm, said suction conduit being connected to the feed conduit for feeding excess powder in a closed cycle back to said spray nozzle arrangement.

31. Powder coating arrangement according to claim 29, wherein said retrieving means comprises a suction conduit which terminates in an area opposite said spray nozzle arrangement.

32. Powder coating arrangement according to claim 29, wherein said spray nozzle arrangement comprises a nozzle arrangement axially symmetrical to said arm for the internal powder coating of hollow bodies.

33. Powder coating arrangement according to claim 27, wherein further means are provided for generating, in the zone of the cabin wall, an electrical field.

34. In a powder coating arrangement comprising conveyor means for conveying workpieces to be coated, a spray nozzle arrangement for spraying air entrained powder towards and on workpieces conveyed by said conveyor means and passing said nozzle arrangement, retrieving means adjacent said nozzle arrangement for retrieving by suction overspray powder, so as to substantially prevent per se such powder contaminating the surroundings of said workpieces, the improvement comprising a cabin surrounding at least an area adjacent said spray nozzle arrangement and said retrieving means, said cabin comprising at least one opening to introduce and remove said workpieces into and from said cabin, and said cabin being connected to pressurizing means for providing an overpressure in said cabin with respect to said surroundings, so as to provide an air current flowing from said cabin out said at least one opening to said surroundings, and wherein said spray nozzle arrangement is connected to an air conditioning device to condition the air for entraining said powder towards and on said workpieces, wherein the spray nozzle arrangement includes a feed conduit arranged at a projecting air, the arm protruding into the cabin, and said retrieving means comprising at least one suction conduit at said arm, said suction conduit being connected to the feed conduit for feeding excess powder in a closed cycle back to said spray nozzle arrangement.

35. Powder coating arrangement according to claim 34, wherein said pressurizing means includes at least one conduit for conditioned air which terminates in the cabin, this conduit being in communication with an air conveyor as a means for producing an air flow directed toward the surroundings from the chamber.

36. Powder coating arrangement according to claim 34, wherein said retrieving means further includes a suction conduit which terminates opposite the termination of the feed conduit.

37. Powder coating arrangement according to claim 34, wherein said spray nozzle arrangement comprises a nozzle arrangement axially symmetrical to said air for the internal powder coating of hollow bodies.

38. Powder coating arrangement according to claim 34, wherein means are provided for generating, in the zone of the cabin wall, an electrical field repelling the powder.

39. In a powder coating arrangement comprising conveyor means for conveying workpieces to be coated, a spray nozzle arrangement for spraying air entrained powder towards and on workpieces conveyed by said conveyor means and passing said nozzle arrangement, retrieving means adjacent said nozzle arrangement for retrieving by suction overspray powder, so as to substantially prevent, per se, such powder contaminating the surrounding of said workpieces, the improvement comprising a cabin surrounding at least an area adjacent said spray nozzle arrangement and said retrieving means, said cabin comprising at least one opening to introduce and remove said workpieces into and from said cabin, and said cabin being connected to pressurizing means for providing an overpressure in said cabin with respect to said surroundings, so as to provide an air current flowing from said cabin out said at least one opening to said surroundings, wherein said spray nozzle arrangement is connected to an air conditioning device to condition the air for entraining said powder towards and on said workpieces, wherein said spray nozzle arrangement includes a feed conduit arranged at a projecting arm, the arm protruding into the cabin, and said spray nozzle arrangement comprising a nozzle arrangement axially symmetrical to said air for the internal powder coating of hollow bodies.

40. Powder coating arrangement according to claim 39, wherein said pressurizing means includes at least one conduit for conditioned air which terminates in the cabin, this conduit being in communication with an air conveyor as a means for producing an air flow directed towards the surroundings from the chamber.

41. Powder coating arrangement according to claim 39 wherein said retrieving means comprises a suction conduit which terminates in an area opposite said spray nozzle arrangement.

42. Powder coating arrangement according to claim 39, wherein further means are provided for generating, in the zone of the cabin wall, an electrical field repelling the powder.

43. A powder coating arrangement comprising conveyor means for conveying workpieces to be coated, a powder spray and powder retrieving arrangement including means for spraying air entrained powder towards and on workpieces and means for retrieving by suction, in the area of the means for spraying, the sprayed powder not applied to said workpieces, means providing conditioned air for entraining said powder, a chamber open at least on one side for conveying said workpieces, said chamber surrounding said powder spray and powder retrieving arrangement, and means for providing an air-flow out of said chamber so as to prevent influences of the ambient surrounding the chamber on powder sprayed and retrieved in said arrangement.

44. Powder coating arrangement according to claim 43, wherein said means for providing an air-flow out of the chamber includes at least one conduit for conditioned air which terminates in the chamber, the conduit being in communication with an air conveyor as a means for producing an air flow from the chamber.

45. Powder coating arrangement according to claim 43, wherein said means for spraying includes a feed conduit arranged at a projecting arm, the air protruding into the chamber.

46. Powder coating arrangement according to claim 45, wherein said retrieving means comprises a suction conduit which terminates in an area opposite said means for spraying.

47. Powder coating arrangement according to claim 43, wherein further means are provided for generating, in the zone of the chamber wall, an electrical field repelling the powder.

* * * * *